US007432234B2

(12) United States Patent
Ochomogo et al.

(10) Patent No.: US 7,432,234 B2
(45) Date of Patent: Oct. 7, 2008

(54) CLEANING SUBSTRATES HAVING LOW SOIL REDEPOSITION

(75) Inventors: Maria G. Ochomogo, Pleasanton, CA (US); Malcolm A. De Leo, Pleasanton, CA (US); Martin A. Phillippi, Pleasanton, CA (US); David L. Budd, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 470 days.

(21) Appl. No.: 11/188,544

(22) Filed: Jul. 25, 2005

(65) Prior Publication Data

US 2008/0128003 A1 Jun. 5, 2008

Related U.S. Application Data

(63) Continuation of application No. 10/738,892, filed on Dec. 16, 2003, now Pat. No. 7,048,806.

(51) Int. Cl.
*C11D 7/32* (2006.01)
*C11D 7/22* (2006.01)
*C11D 17/00* (2006.01)

(52) U.S. Cl. ..... 510/295; 510/216; 510/238; 510/499; 510/504

(58) Field of Classification Search ..... None
See application file for complete search history.

(56) References Cited

U.S. PATENT DOCUMENTS

| | | | | |
|---|---|---|---|---|
| 3,694,364 | A | 9/1972 | Edwards | 252/90 |
| 3,954,113 | A * | 5/1976 | Bohrer et al. | 132/200 |
| 4,624,890 | A | 11/1986 | Lloyd et al. | 428/290 |
| 4,880,558 | A | 11/1989 | Jost et al. | 252/174.23 |
| 6,156,720 | A | 12/2000 | Boeckh | 510/475 |
| 6,251,849 | B1 | 6/2001 | Jeschke et al. | 510/470 |
| 6,436,445 | B1 | 8/2002 | Hei et al. | 424/667 |
| 6,559,116 | B1 | 5/2003 | Godfroid et al. | 510/499 |
| 6,653,274 | B1 | 11/2003 | Godfroid et al. | 510/499 |
| 6,730,654 | B2 | 5/2004 | Godfroid et al. | 510/499 |
| 6,794,352 | B2 | 9/2004 | Svendsen | 510/438 |
| 6,797,856 | B1 | 9/2004 | Kolb et al. | 604/360 |
| 2001/0040136 | A1 | 11/2001 | Wei | 210/767 |
| 2002/0050016 | A1 | 5/2002 | Willman et al. | 15/104.002 |
| 2002/0132541 | A1 | 9/2002 | Vogt | 442/64 |
| 2002/0189040 | A1 | 12/2002 | Svendsen | 15/104.93 |
| 2003/0027470 | A1 | 2/2003 | Chang et al. | 442/59 |
| 2003/0039815 | A1 | 2/2003 | Roth | 428/292.1 |
| 2004/0030080 | A1 | 2/2004 | Chang et al. | 526/318.44 |
| 2004/0031749 | A1 | 2/2004 | Koslow | 210/505 |
| 2004/0116026 | A1 | 6/2004 | Kubose et al. | 442/340 |
| 2004/0137815 | A1 | 7/2004 | Ellis et al. | 442/123 |
| 2005/0130870 | A1 | 6/2005 | Ochomogo et al. | 510/499 |
| 2005/0137540 | A1 | 6/2005 | Villanueva et al. | 604/360 |

* cited by examiner

*Primary Examiner*—Gregory R Del Cotto
(74) *Attorney, Agent, or Firm*—David Peterson

(57) ABSTRACT

Incorporating dirt-attracting polycationic polymers, such as polyethyleneimines, into cleaning wipes, mop pads, and similar substrates, improves dirt pick-up and retards redeposition of the dirt back onto the cleaned surface. The polymers can be incorporated directly into the non-woven substrates or they can be formulated with a cleaning composition for use with the substrate. The substrate containing the dirt-attracting polycationic polymers can be employed to clean hard and soft surfaces. The presence of the dirt-attracting polycationic polymers also facilitates biocide release from the substrates.

5 Claims, No Drawings

CLEANING SUBSTRATES HAVING LOW SOIL REDEPOSITION

CROSS REFERENCE TO RELATED APPLICATION

The present application is a Continuation of application Ser. No. 10/738,892 to Ochomogo et al., now U.S. Pat. No. 7,048,806 which was filed Dec. 16, 2003, entitled "Cleaning Substrate Having Low Soil Redeposition", and incorporated herein.

FIELD OF THE INVENTION

The present invention is directed to the use of dirt-attracting polycationic polymers, such as polyethyleneimines, with cleaning wipes, mop pads, and similar substrates, to improve dirt pick-up and to retard redeposition of the dirt back onto the cleaned surface. The polymers can be incorporated directly into the non-woven substrates or they can be formulated with a cleaning composition for use with the substrate. The dirt-attracting polycationic polymers can be employed to clean hard surfaces such as floors, counter-tops, toilets, windows, and autos as well as soft surfaces on clothing, furnishings, and carpets. The presence of the dirt-attracting polycationic polymers also facilitates biocide release from the substrates.

BACKGROUND OF THE INVENTION

Household dirt and soil are usually removed from hard and soft surfaces with a cloth, sponge or other similar hand held implement. To facilitate dirt and soil removal, there are numerous commercially availably surface cleaning compositions in the prior art. Generally, the liquid cleaners consist of some small percentage of surfactant, such as a nonionic or anionic surfactant, a solvent, such as an alcohol, ammonium hydroxide, a builder, and water. A perfume may be added to impart a pleasant fragrance to the cleaner, as well as to mask the unpleasant odor of the solvent and/or surfactant, and, perhaps, a dye to is added impart a pleasant color to the cleaning composition.

Liquid cleaners have limited cleaning efficiency with respect to particular types of soils, and are subject to streaking or redepositing of soil on the surface. The art is in need of techniques to improve the cleaning efficiency of cleaning substrates especially with respect to soil and dirt pickup. In particular, the techniques should be compatible and/or usable with existing cleaning products.

SUMMARY OF THE INVENTION

The present invention is based in part on the discovery that impregnating a cleaning substrate with a dirt-attracting polycationic polymer unexpectedly prevents redeposition of soil and dirt onto the cleaned surface. Preferred dirt-attracting polycationic polymers include, for example, polyethyleneimines. The dirt-attracting polycationic polymers can be employed neat or can be mixed with other components of a liquid cleaner.

In one aspect, the invention is directed to a method of removing dirt from a dirt laden hard surface that comprises the steps of:

a. providing a surface cleaning substrate which comprises an absorbent or adsorbent material wherein the substrate is impregnated with a dirt-attracting polycationic polymer; and b. engaging the dirt laden hard surface with a surface of the cleaning substrate with sufficient force to remove dirt from the dirt laden hard surface whereby substantially no dirt becomes redeposited onto the dirt laden hard surface once the dirt is removed therefrom.

In another aspect, the invention is directed to a method of removing dirt from a dirt laden hard surface that comprises the steps of:

a. providing a surface cleaning substrate which comprises an absorbent or adsorbent material;
b. applying a liquid cleaning solution onto the dirt laden hard surface wherein the liquid cleaning solution comprises a polycationic polymer; and
c. engaging the dirt laden hard surface with a surface of the cleaning substrate with sufficient force to remove dirt from the dirt laden hard surface whereby essentially no dirt becomes redeposited onto the dirt laden hard surface once it is removed therefrom.

DETAILED DESCRIPTION OF THE PREFERRED EMBODIMENTS

The present invention relates to a cleaning implement that includes a substrate that has been impregnated with a dirt-attracting polycationic polymer. In addition, the invention relates to methods of cleaning hard and soft surfaces using the so-impregnated substrate or using a non-impregnated substrate on a hard or soft surface on which dirt-attracting polycationic polymers have been applied in the form of a liquid cleaner.

It has been demonstrated that using the dirt-attracting polycationic polymer either by incorporating it into a substrate or by applying a liquid cleaner containing the polymer results in significant cleaning efficiency. Because a treated cleaning article could more efficiently prevent dirt from being redeposited, the amount of actives in the cleaner could be reduced to achieve the same amount of cleaning. Thus an aqueous glass cleaner composition would require essentially no surfactant when it is employed either to treated an article (non-woven or other cellulosic substrate) and/or applied to glass that is scrubbed with an article.

In addition, the presence lower active levels in the cleaner or substrate containing the cleaner will exhibit the concomitant effect of improve filming/streaking as less of these cleaning actives is available to be redeposited on the surface being cleaned.

The phrase "dirt-attracting polycationic polymer" refers to a polymer comprising positively-charged single units, although some non-positively charged units may be present in the polymer, that are capable of sequestering hydrophobic, e.g., grime, oil, soot, and hydrophilic, e.g., clay, soil. These soil materials are collectively referred to as "dirt". It is believed that the beneficial cleaning attributes associated with substrates that have the dirt-attracting polycationic polymer incorporated therein is due, at least in part, to high positive charge density created by the polymer. Thus, so impregnated substrates will not only attract more dirt but is expected to attract lint or dust, viruses, and other contaminants from the environment.

The polycationic polymers of the present invention exhibit a net positive charge at a pH range of 1 to 13, which is the pH of the cleaning composition described herein. Typically, the average molecular weight of the dirt-attracting polycationic polymer will be from 1,000 to 20,000,000 Daltons and preferably from 100,000 to 2,000,000 Daltons and most preferably from 500,000 to 2,000,000 Daltons. The dirt-attracting polycationic polymers can be employed as salts. In general any counterion may be employed, including, for example, halides, organic carboxylates, organic sulfonic acid anions and the like. A treated non-woven article will hold more dust and pick up because of the heightened charge density created on the non-woven substrate.

Preferred dirt-attracting polycationic polymers include polyalkyleneimines and particularly polyethyleneimines. A suitable polyethyleneimne having an average MW of 750,000 and a charge density of approximately 18 meq/g (pH 4.5) is commercially available as LUPASOL P (BASF Corp.). The polymer may have a charge density greater than 10 meq/gm at pH 4.5.

In use, the dirt-attracting polycationic polymers can be applied directly onto the cleaning surface of a substrate. Thereafter, the substrate can be used in its "dry" form to clean surfaces. The dry substrate can also be used in conjunction with a liquid cleaner that has been applied to the surface to be cleaned. Alternatively, a "wet" substrate can be formed when an aqueous cleaning composition, which contains the polymers and one or more additional components, is incorporated into the substrate. The data described herein evidence that dry and wet substrates will adhere large amounts of dirt. When incorporated with the substrate, either dry or as part of a "wet" substrate, the dirt-attracting polycationic polymer typically comprises 0.01% to 0.5% and preferably 0.05% to 0.25% of the total weight of the dry or "wet" substrate.

Regardless of whether the dirt-attracting polycationic polymers are applied neat or as part of an aqueous cleaning composition, high amounts of the polymers should be avoided since this may cause the substrate to become too "tacky" resulting in a high coefficient of friction in use. Preferably, the polymer in use is non-tacky and does not substantially contribute to the coefficient of friction. When incorporated as part of an aqueous cleaning composition, the dirt-attracting polycationic polymer typically comprises 0.01% to 0.5% and preferably 0.05% to 0.25% of the composition. (All percentages herein are based on weight unless otherwise noted.)

The term "substrate" refers to any suitable natural and/or synthetic adsorbent and/or adsorbent material that can be employed to clean hard and soft surfaces by physical contact, e.g, wiping, scrubbing, buffing, polishing, rinsing, and the like. Preferred substrates are non-woven which means that the material is formed without the aid of a textile weaving or knitting process. The non-woven material can comprise, for example, non-woven, fibrous sheet materials or meltblown, coform, air-laid, spun bond, wet laid, bonded-carded web materials, and/or hydroentangled (also known as spunlaced) materials. The substrate can also include wood pulp, a blend of wood pulp, and/or synthetic fibers, e.g., polyester, RAYON, NYLON, polypropylene, polyethylene, and/or cellulose polymers.

The substrate can incorporate a backing member that may be pervious or impervious to a cleaning composition. The backing member provides structural support to the substrate, imparts texture to the substrate, and/or provides a prophylactic barrier. The backing member can be manufactured from any suitable material including, for example, woven or non-woven material, polymeric material, natural fiber, synthetic fiber, or mixtures thereof.

A preferred substrate is manufactured in the form of a general purpose cleaning wipe that has at least one layer of non-woven absorbent or adsorbent material. The wipe can further include wood pulp or a blend of wood pulp and a synthetic fiber, without limitation, such as polyester, RAYON, NYLON, polypropylene, polyethylene, other cellulose polymers; or a synthetic fiber or mixture of such fibers. A binder may or may not be present. Manufacturers include Kimberly-Clark, E.I. du Pont de Nemours and Company, Dexter, American Nonwovens, James River, BBA Nonwovens and PGI. Examples of such substrates are described in U.S. Pat. Nos. 6,340,663 to De Leo, 4,781,974 and 4,615,937 to Bouchette et al., 4,666,621 to Clark et al., and 5,908,707 Cabell et al., and Amundson et al., WO 98/03713, Mackey et al., WO 97/40814, Mackey et al., WO 96/14835 and Moore, EP 750063, all of which are incorporated herein by reference.

Woven materials, such as cotton fibers, cotton/nylon blends, or other textiles may also be used in the substrate. Regenerated cellulose, polyurethane foams, and the like, which are used in making sponges, may also be suitable for use herein.

The cleaning substrate's liquid loading capacity should be at least about 50%-1000% of the dry weight thereof, most preferably at least about 200%-800%. This is expressed as loading ½ to 10 times the weight (or, more accurately, the mass) of the substrate. The substrate varies without limitation from about 0.01 to about 1,000 grams per square meter, most preferably 25 to 120 grams/$m^2$ (referred to as "basis weight") and typically is produced as a sheet or web, which is cut, die-cut, or otherwise sized into the appropriate shape and size.

The cleaning substrate can be individually sealed with a heat-sealable or glueable thermoplastic overwrap (such as polyethylene, MYLAR, and the like). More preferably the wipes can be packaged as numerous, individual sheets which are then impregnated or contacted with the dirt-attracting polycationic polymer or with a liquid cleaning composition containing the dirt-attracting polycationic polymer. Even more preferably, the wipes can be formed as a continuous web during the manufacturing process and loaded into a dispenser, such as a canister with a closure, or a tub with closure. The closure is to seal the moist wipes from the external environment and to prevent premature volatilization of the liquid ingredients. Without limitation, the dispenser may be formed of plastic, such as high density polyethylene, polypropylene, polycarbonate, polyethylene pterethalate (PET), polyvinyl chloride (PVC), or other rigid plastics. The continuous web of wipes could preferably be threaded through a thin opening in the top of the dispenser, most preferably, through the closure. A means of sizing the desired length or size of the wipe from the web would then be needed. A knife blade, serrated edge, or other means of cutting the web to desired size can be provided on the top of the dispenser, for non-limiting example, with the thin opening actually doubling in duty as a cutting edge. Alternatively, the continuous web of wipes could be scored, folded, segmented, or partially cut into uniform or non-uniform sizes or lengths, which would then obviate the need for a sharp cutting edge. Further, as in hand tissues, the wipes could be interleaved, so that the removal of one wipe advances the next, and so forth.

The cleaning wipes will preferably have a certain wet tensile strength which is without limitation about 25 to about 250 Newtons/m, more preferably about 75-170 Newtons/m.

Another preferred substrate is manufactured in the form of clean pads for used in conjunction with handheld implements that are described, for example, in U.S. Pat. No. 6,540,424 to Hall et al., which is incorporated herein. As described in the Hall et al. patent, the cleaning pad consists of a cleaning surface, which comes into direct contact with dirt and debris. This surface comprises an absorbent material which has the ability to absorb fluid, including superabsorbent materials. The cleaning pad preferably has a polyethylene film backing layer that is bonded to the cleaning surface. The film backing layer can be formed of polyethylene or any suitable plastic, rubber, other elastomeric, polymeric or other flexible material.

Suitable materials for the cleaning surface of the cleaning pad are absorbent materials such as the unbonded web material described in U.S. Pat. No. 5,858,112 to Stokes et al. and in U.S. Pat. No. 5,962,112 to Haynes et al. Other suitable materials are described by U.S. Pat. No. 4,720,415 to Vander Wielan et al. and superabsorbent materials are described in U.S. Pat. Nos. 4,995,133 91 and 5,638,569 both to Newell, U.S. Pat. No. 5,960,508 to Holt et al., and U.S. Pat. No. 6,003,191 to Sherry et al., all of which are incorporated by reference herein.

In a preferred embodiment, the cleaning pad substrate comprises a spunbond fiber non-woven web. The spunbond fibers comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity.

Alternatively, the absorbent material for the cleaning pad comprises a laminate of an air-laid composite and a spunbond fiber nonwoven web. The non-woven web comprises monocomponent spunbond fibers of polypropylene having a basis weight of approximately 14 grams per square meter. The air-laid composite comprises from about 85% to about % kraft pulp fluff and from about 10% to about 15% bicomponent staple fibers. The bicomponent staple fibers have a sheath-core configuration; the core component comprises polyethylene terephthalate and the sheath component comprises polyethylene.

The dirt-attracting polycationic polymers can be incorporated into the substrate neat or in combination with one or more cleaning components and/or adjuncts. Alternatively, the dirt-attracting polycationic polymers can be incorporated as part of an aqueous cleaning composition. Finally, the non-impregnated substrates can be employed to cleaning surfaces onto which the cleaning composition has been applied.

Cleaning Composition

The following are components for formulating suitable aqueous cleaning solutions containing the dirt-attracting polycationic polymers. It is understood that the choice of components for the composition depends on the surface to be cleaned. Water typically will be the predominant ingredient and it should be present at a level of about 40% to 99.5% and preferably about 90% to about 98% of the cleaning composition. As is apparent, concentrated forms of the cleaning composition will have significantly less water.

A. Surfactant

The cleaning composition preferably contains one or more surfactants selected from anionic, nonionic, cationic, ampholytic, amphoteric and zwitterionic surfactants and mixtures thereof. Surfactants, among other things, aid in the removal of soil from carpets. Suitable anionic, nonionic, ampholytic, and zwitterionic surfactants are disclosed in U.S. Pat. No. 3,929,678 to Laughlin and in Heuring, *Surface Active Agents and Detergents*, Vol. I by Schwartz, Perry and Berch; suitable cationic surfactants are disclosed in U.S. Pat. No. 4,259,217 to Murphy. Where present, ampholytic, amphotenic and zwitteronic surfactants are generally used in combination with one or more anionic and/or nonionic surfactants. The surfactants are preferably present at a level of from 0.1% to 60% and preferably from 0.5% to 5% of the composition.

In preferred cleaning compositions, an anionic surfactant useful for detersive purposes can be added. These can include salts (including, for example, sodium, potassium, ammonium, and substituted ammonium salts such as mono-, di- and triiethanolamine salts) of the anionic sulfate, sulfonate, carboxylate and sarcosinate surfactants. Anionic sulfate and sulfonate surfactants are preferred. The anionic surfactants is preferably present at a level of from 0.1% to 60%, more preferably from 0.1% to 5%, and most preferably from 0.5% to 2%. Preferred are surfactants systems comprising a sulfonate and a sulfate surfactant, preferably a linear or branched alkyl benzene sulfonate and alkyl ethoxylsulfates, as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$-$C_{17}$acyl-N—($C_1$-$C_4$ alkyl) and -N—($C_1$-$C_2$ hydroxyalkyl) glucamine sulfates, and sulfates of alkylpolysacchanides such as the sulfates of alkylpo lyglucoside (the nonionic nonsulfated compounds being described herein). Alkyl sulfate surfactants are preferably selected from the linear and branched primary $C_{10}$-$C_{18}$ alkyl sulfates, more preferably the $C_{11}$-$C_{15}$ branched chain alkyl sulfates and the $C_{12}$-$C_{14}$ linear chain alkyl sulfates.

Alkyl ethoxysulfate surfactants are preferably selected from the group consisting of the $C_{10}$-$C_{18}$ alkyl sulfates which have been ethoxylated with from 0.5 to 20 moles of ethylene oxide per molecule. More preferably, the alkyl ethoxysulfate surfactant is a $C_{11}$-$C_{18}$, most preferably $C_{11}$-$C_{15}$ alkyl sulfate which has been ethoxylated with from 0.5 to 7, preferably from 1 to 5, moles of ethylene oxide per molecule. A particularly preferred aspect of the invention employs mixtures of the preferred alkyl sulfate and/or sulfonate and alkyl ethoxysulfate surfactants. Such mixtures are disclosed in WO 93/18124.

Anionic sulfonate surfactants suitable for use herein also include the salts of $C_5$-$C_{20}$ linear alkylbenzene sulfonates, alkyl ester sulfonates, $C_6$-$C_{22}$ primary or secondary alkane sulfonates, $C_6$-$C_{24}$ olefin sulfonates, sulfonated polycarboxylic acids, alkyl glycerol sulfonates, fatty acyl glycerol sulfonates, fatty oleyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyls'), especially certain secondary soaps as described herein. Suitable alkyl ethoxy carboxylates include those with the formula $RO(CH_2CH_2O)x\ CH_2C00^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxypolycarboxylate surfactants include those having the formula RO—($CHR^1$—$CHR^2$—O)—$R^3$ wherein R is a $C_6$ to $C_{18}$ alkyl group, x is from 1 to 25, $R^1$ and $R^2$ are selected from the group consisting of hydrogen, methyl acid radical, succinic acid radical, hydroxysuccinic acid radical, and mixtures thereof, and $R^3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula R—CON($R^1$)CHCOOM, wherein R is a $C_5$-$C_{17}$ linear or branched alkyl or alkenyl group, $R^1$ is a $C_1$-$C_4$ alkyl group and M is an alkali metal ion. Preferred examples are the myristyl and oleoyl methyl sarcosinates in the form of their sodium salts.

Essentially any alkoxylated nonionic surfactants can be employed. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Polyhydroxy fatty acid amides suitable for use are those having the structural formula $R^2CONR^1Z$ wherein: $R^1$ is H, $C_1$-$C_4$ hydrocarbyl, 2-hydroxyethyl, 2-hydroxypropyl, ethoxy, propoxy, or a mixture thereof, preferable $C_1$-$C_4$ alkyl, more preferably $C_1$ or $C_2$ alkyl, most preferably $C_1$ alkyl (i.e., methyl); and $R^2$ is a $C_5$-$C_{31}$ hydrocarbyl, preferably straight-chain $C_5$-C19 alkyl or alkenyl, more preferably straight-chain $C_9$-$C_{17}$ alkyl or alkenyl, most preferably straight-chain $C_{11}$-$C_{17}$ alkyl or alkenyl, or mixture thereof, and Z is a polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is a glycityl.

Suitable fatty acid amide surfactants include those having the formula: $R^1CON(R^2)_2$ wherein $R^1$ is an alkyl group containing from 7 to 21, preferably from 9 to 17 carbon atoms and each $R^2$ is selected from the group consisting of hydrogen, $C_1$-$C_4$ alkyl, $C_1$-$C_4$ hydroxyalkyl, and —$(C_2H_{40})_xH$, where x is in the range of from 1 to 3.

Suitable alkylpolysaccharides are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula: $R^2O(C_nH_{2n}O)_t$(glycosyl)$_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Suitable amphoteric surfactants include the amine oxide surfactants and the alkyl amphocarboxylic acids. Suitable amine oxides include those compounds having the formula $R_3(OR^4)_xNO(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof-, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$-$C_{18}$ alkyl dimethylamine oxide, and $C_{10}$-$_{18}$ acylamido alkyl dimethylamine oxide. A suitable example of an alkyl aphodicarboxylic acid is MIRANOL $C_2M$ Conc. manufactured by Miranol, Inc., Dayton, N.J.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwittenionic surfactants.

Suitable betaines are those compounds having the formula $R(R^1)_2N^+R^2COO^-$ wherein R is a $C_6$-$C_{18}$ hydrocarbyl. group, each $R^1$ is typically $C_1$-$C_3$ alkyl, and $R^2$ is a $C_1$-$C_5$ hydrocarbyl group. Preferred betaines are $C_{12}$-$C_{18}$ dimethylammonio hexanoate and the $C_{10}$-$C_{18}$ acylamidopropane (or ethane) dimethyl (or diethyl) betaines. Complex betaine surfactants can also be used.

Suitable cationic surfactants include the quaternary ammonium surfactants. Preferably the quaternary ammonium surfactant is a mono $C_6$-$C_{16}$, preferably $C_6$-$C_{10}$ N-alkyl or alkenyl ammonium surfactants wherein the remaining N positions are substituted by methyl, hydroxyethyl or hydroxypropyl groups. Preferred cationic surfactants include monoalkoxylated and bis-alkoxylated amines.

Another suitable group of cationic surfactants are cationic ester surfactants. The cationic ester surfactant is a, preferably water dispersible, compound having surfactant properties comprising at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529.

The ester linkage and cationically charged group can be separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Other suitable surfactants are cationic mono-alkoxylated amine surfactants preferably of the general formula: $R^1R^2R^3N^+ApR^4\ X^-$ wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8. Preferably the $A_pR^4$ group in the formula has p=1 and is a hydroxyalkyl group, having no greater than 6 carbon atoms whereby the —OH group is separated from the quaternary ammonium nitrogen atom by no more than 3 carbon atoms. Particularly preferred $A_pR^4$ groups are —$CH_2CH_2$—OH, —$CH_2CH_2CH_2$—OH, —$CH_2CH(CH_3)$—OH and —$CH(CH_3)CH_2$—OH, with —$CH_2CH_2$—OH being particularly preferred. Preferred $R^1$ groups are linear alkyl groups. Linear $R^1$ groups having from 8 to 14 carbon atoms are preferred.

Another highly preferred cationic mono-alkoxylated amine surfactants have the formula $R^1(CH_3)(CH_3)N^+(CH_2CH_{20})_{2-5}H\ X^-$ wherein $R^1$ is $C_{10}$-$C_{18}$ hydrocarbyl and mixtures thereof, especially $C_{10}$-$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_{2O}$) units (EO) are replaced by butoxy, isopropoxy [$CH(CH_3)CH_{2O}$] and [$CH_2CH(CH_3)O$] units (i-Pr) or n-propoxy units (Pr), or mixtures of EO and/or Pr and/or i-Pr units.

The level of the cationic mono-alkoxylated amine surfactants is preferably from 0.1% to 20%, more preferably from 0.2% to 7%, and most preferably from 0.3% to 3.0%.

The cationic bis-alkoxylated amine surfactant preferably has the general formula: $R^1R^2N^+ ApR^3\ A'qR^4\ X^-$ wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$-$C_4$ alkoxy, especially ethoxy, (i.e., —$CH_2CH_2O$—), propoxy, butoxy and mixtures thereof, p is from 1 to about 30, preferably 1 to about 4 and q is from 1 to about 30, preferably 1 to about 4, and most preferably both p and q are 1.

Highly preferred cationic bis-alkoxylated amine surfactants further include those of the formula $R^1CH_3N^+(CH_2CH_2OH)(CH_2CH_2OH)\ X^-$ wherein $R^1$ $C_{10}$-$C_{18}$ hydrocarbyl and mixtures thereof, preferably $C_{10}$, $C_{12}$, $C_{14}$ alkyl and mixtures thereof $X^-$ is any convenient anion to provide charge balance, preferably chloride. With reference to the general cationic bis-alkoxylated amine structure noted above, since in a preferred compound $R^1$ is derived from (coconut) $C_{12}$-$C_{14}$ alkyl fraction fatty acids, $R^2$ is methyl and $A_pR^3$ and $A^pR^4$ are each monoethoxy.

Other useful cationic bis-alkoxylated amine surfactants include compounds of the formula: $R^1R^2N^+$—$(CH_2CH_2O)_p$H—$(CH_2CH_2HO)_qH\ X^-$ wherein $R^1$ is $C_{10}$-$C_{18}$ hydrocarbyl, preferably $C_{10}$-$C_{14}$ alkyl, independently p is 1 to about 3 and q is 1 to about 3, $R^2$ is $C_1$-$C_3$ alkyl, preferably methyl, and $X^-$ is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3)O$] units (i-Pr) or n-propoxy units (Pr), or mixtures of EO and/or Pr and/or i-Pr units.

B. Solvent

The cleaning composition preferably includes organic solvents which solubilize hydrophobic materials as well as some of the cleaning components. The solvent is preferably present at a level of from 0% to 10% and preferably from 0.05% to 5% of the composition. Suitable solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water soluble solvent when employed.

C. Additional Adjuncts

The cleaning composition optionally contains one or more of the following adjuncts: stain blocking agents, stain and soil repellants, enzymes, lubricants, insecticides, miticides, anti-allergen agents, odor control agents, fragrances and fragrance release agents, brighteners or fluorescent whitening agents, oxidizing or reducing agents polymers which leave a film to trap or adsorbs bacteria, virus, mite, allergens, dirt, dust, or oil.

The cleaning composition may includes additional adjuncts. The adjuncts include, but are not limited to, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermacet, candelilla, paraffin, lanolin, shellac, esparto, ouricuri, polyethylene wax, chlorinated naphthaline wax, petrolatu, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, methyl, ethyl, clays, and/or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases, and/or hydrotropes such as xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. DANTAGARD and/or GLYDANT) and/or short chain alcohols (e.g. ethanol and/or IPA).

The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

D. Antimicrobial Agent

An antimicrobial agent can also be included in the cleaning composition. Non-limiting examples of useful quaternary compounds that function as antimicrobial agents include benzalkonium chlorides and/or substituted benzalkonium chlorides, di($C_6$-$C_{14}$)alkyl di short chain ($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyl dimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are especially preferred. Typical concentrations for biocidal effectiveness of these quaternary compounds, especially in the low-surfactant compositions, range from about 0.001% to about 0.8% and preferably from about 0.005% to about 0.3% of the usage composition. The weight percentage ranges for the biguanide and/or quat compounds in the cleaning composition is selected to disinfect, sanitize, and/or sterilize most common household and industrial surfaces.

A preferred method of using quaternary biocides is to incorporate them into a substrate in conjunction with the dirt-attracting polycationic polymer. It is expected that the positively charged polymers will compete with the quaternary biocide for bonding cites on the substrates. Thus fewer biocide molecules will be adsorbed onto these sites and more will be released from the substrate.

Non-quaternary biocides are also useful. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics.

These antimicrobial, antifungal or antiallergen materials include water-soluble, film-forming polymers (See, U.S. Pat. No. 6,454,876 to Ochomogo which is incorporated herein by reference), quaternary ammonium compounds and complexes therewith (See, U.S. Pat. Nos. 6,482,392, 6,080,387, 6,284,723, 6,270,754, 6,017,561 and 6,013,615 to Zhou et al. all of which are incorporated herein by reference), essential oils, such as nerolidol (See, U.S. Pat. No. 6,361,787 to Shaheen et al. incorporated by reference), KATHON (See, U.S. Pat. No. 5,789,364 to Sells et al., and U.S. Pat. No. 5,589,448 to Koerner et al., which are incorporated herein by reference), and, possibly, bleaches, such as hydrogen peroxide and alkali metal hypochlorite.

E. Miticide and Anti-Allergen Agents

Optional miticides include boron compounds and salts, including boric acid, borates, octaborate, tetraborate, borax, and metaborate. Other optional miticides include benzylbenzoate, phenyl salicylate, diphenylamine, methyl p-naphthyl ketone, coumarin, phenethyl benzoate, benzyl salicylate, phenyl benzoate, N-fluorodichloromethylthio-cyclohexenedicarboxylmide, p-nitrobenzoic acid methyl ester, p-chlorometaxylenol, bromocinnamic aldehyde, 2,5-dichloro-4-bromophenol, N,N-dimethyl-N'-tryl-N'-(fluorodichloromethylthio)-sulfamide, 2-phenylphenol, sodium 2-phenylphenolate, 5-chloro-2-methyl-4-isothiazoline-3-one, 2-methyl-4-isothiazonoline-3-one, benzimidazolylmethyl-carbamate, the antimicrobials listed herein, and mixtures thereof.

Optional anti-allergen metal ions include metallic salts are selected from the group consisting of zinc, stannous, stannic, magnesium, calcium, manganese, titanium, iron, copper, nickel, and mixtures thereof. Other optional anti-allergen agents include polyphenol compounds including tannins, catechins, and gallic acid, hydrogen peroxide, salicylic acid, citric acid, lactic acid, glycolic acid, ascorbic acid, gluconic acid, pyruvic acid, glucaric acid, hydroxy benzoic acid, hydroxyglutamic acid, hydroxyphathalic acids, malic acid, and mixtures and salts thereof.

Film forming polymers can reduce allergens in the air. Suitable film-forming polymers include, water-soluble polymers selected from the group consisting of starch, polyvinyl alcohols, methyl cellulose and its derivatives, polyacrylic acids, polyethylene glycols with molecular weight higher than 5000, polyethylene, polypropylene glycol with molecular weight higher than 8000, Cosmetic Toiletry Fragrances Association polyquatemium compounds 1 through 14, polyvinyl pyrrolidone, and mixtures thereof. Specific examples of certain preferred film forming polymers are selected from the group consisting of hydroxy-propyl starch, DAISEL MC 1310, Kuraray poly vinyl alcohol 205, N-Polyvinyl-2 pyrrolidone, and mixtures thereof.

As used herein, the term "plant essential oil" or "plant essential oil compound" (which shall include derivatives thereof) generally refers to a monocyclic, carbocyclic ring structure having six-members and substituted by at least one oxygenated or hydroxyl functional moiety. Examples of plant essential oils encompassed within the present invention, include, but are not limited to, members selected from the group consisting of aldehyde $C_{16}$ (pure), a-terpineol, amyl cinnamic aldehyde, amyl salicylate, anisic aldehyde, benzyl alcohol, benzyl acetate, cinnamaldehyde, cinnamic alcohol, carvacrol, carveol, citral, citronellal, citronellol, p-cymene, diethyl phthalate, dimethyl salicylate, dipropylene glycol, eucalyptol (cineole), eugenol, iso-eugenol, galaxolide, geraniol, guaiacol, ionone, menthol, menthyl salicylate, methyl anthranilate, methyl ionone, methyl salicylate, a-phellandrene, pennyroyal oil, perillaldehyde, 1- or 2-phenyl ethyl alcohol, 1- or 2-phenyl ethyl propionate, piperonal, piperonyl acetate, piperonyl alcohol, D-pulegone, terpinen-4-ol, terpinyl acetate, 4-tert-butylcyclohexyl acetate, thyme oil, thymol, metabolites of trans-anethole, vanillin, ethyl vanillin, cedarwcod oil, hexadecyltrimethylammonium chloride, aluminium chlorohydrate, 1-propoxy-propanol-2, polyquarternium-10, silica gel, propylene glycol alginate, ammonium sulphate, hinokitiol, L-ascorbic acid, tannic acid and derivatives, chlorohexidine, maleic anhydride, hinoki oil, a composite of AgCl and $TiO_2$, diazolidinyl urea, 6-isopropyl-m-cresol, urea, cyclodextrin, hydrogenated hop oil, polyvinylpyrrolidone, N-methylpyrrolidone, the sodium salt of anthraquinone, potassium thioglycolate, and glutaraldehyde, jasmone, dihydrojasmone, lower alkyl esters of jasmonic acid, lower alkyl esters of dihydrojasmonic acid, framesol, nerolidol, phytol, isophytol, geranylgeraniol, and the like. The essential oil can also be selected from oil is selected from the group of Anise, Balsam, Basil, Bay, Birch, Cajeput, Camphor, Caraway, Cinnamon, Clove, Coriander, Dill, Fennell, Fir, Garlic, Lavender, Lavendin, Lemongrass, Marjoram, Nutmeg, Peppermint, Pine, Rosemary, Rue, Sage, Spearmint, Tea Tree, Thuja, Thyme, Wintergreen and Ylang-Ylang. Preferred essential oils include a-terpineol, eugenol, cinnamic alcohol, benzyl acetate, 2-phenyl ethyl alcohol, and benzyl alcohol.

F. Soil and Stain Resist Agents

Soil resist agents resist or repel dirt, oil, or other typically hydrophobic substances from the carpet. Fluorochemical soil-resist agents may include polymers or compounds having pendent or end groups of perfluoroalkyl moieties, fluorosurfactants, or fluoro-intermediates. Examples of some suitable fluorochemical soil-resist agents include ZONYL 7950 and ZONYL 5180, which are available from DuPont. When employed the soil and stain resist agents are preferably present at a level of from 0.01% to 3% and preferably from 0.05% to 1% of the composition The optional stain-resist agent may also be selected from the group consisting of copolymers of hydrolyzed maleic anhydride with aliphatic alpha olefins, aromatic olefins, or vinyl ethers, poly (vinyl methyl ether/maleic acid) copolymers, homopolymers of methacrylic acid, and copolymers of methacrylic acid. Suitable poly (vinyl methyl ether/maleic acid) copolymers are commercially available, for instance, from ISP Corporation, New York, N.Y. and Montreal, Canada under the product names GANTREZ AN Copolymer (AN-119 copolymer, average molecular weight of 20,000; AN-139 copolymer, average molecular weight of 41,000; AN-149 copolymer, average molecular weight of 50,000; AN-169 copolymer, average molecular weight of 67,000; AN-179 copolymer, average molecular weight of 80,000), GANTREZ S (GANTREZ S97, average molecular weight of 70,000), and GANTREZ ES (ES-225, ES-335, ES-425, ES-435), GANTREZ V (V-215, V-225, V-425). Preferably, the stain-resist agent is ZELAN 338, which is available from DuPont.

Suitable anti-resoiling polymers also include soil suspending polyamine polymers. Particularly suitable polyamine polymers are alkoxylated polyamines including so-called ethoxylated polyethylene amines, i.e., the polymerized reaction product of ethylene oxide with ethyleneimine. Suitable ethoxylated polyethylene amines are commercially available from Nippon Shokubai CO., LTD under the product names ESP-0620A (ethoxylated polyethylene amine wherein n=2 and y=20) or from BASF under the product names ES-8165 and from BASF under the product name LUTENSIT K –187/50.

Suitable anti-resoiling polymers also include polyamine N-oxide polymers. The polyamine N-oxide polymer can be obtained in almost any degree of polymerization. Typically, the average molecular weight is within the range of 1,000 to 100,000; more preferred 5,000 to 100,000; most preferred 5,000 to 25,000. Suitable poly vinyl pyridine-N-oxide polymers are commercially available from Hoechst under the trade name of Hoe S 4268, and from Reilly Industries Inc. under the trade name of PVNO.

Furthermore, suitable anti-resoiling polymers include N-vinyl polymers. Suitable N-vinyl polymers include polyvinyl pyrrolidone polymers, co-polymers of N-vinylpyrrolidone and N-vinylimidazole, co-polymers of N-vinylpyrrolidone and acrylic acid, and mixtures thereof. Suitable co-polymers of N-vinylpyrrolidone and N-vinylimidazole are commercially available from BASF, under the trade name of Sokalan PG55. Suitable vinylpyrrolidone homopolymers, are commercially available from BASF under the trade names LUVISKOL K15 (viscosity molecular weight of 10,000), LUVISKOL K25 (viscosity molecular weight of 24,000), LUVISKOL K30 (viscosity molecular weight of 40,000), and other vinyl pyrrolidone homopolymers known to persons skilled in the detergent field (see for example EP-A-262,897 and EP-A-256,696). Suitable co-polymers of N-vinylpyrrolidone and acrylic acid are commercially available from BASF under the trade name SOKALAN PG 310. Preferred N-vinyl polymers are polyvinyl pyrrolidone polymers, co-polymers of N-vinylpyrrolidone and N-vinylimidazole, co-polymers of N-vinylpyrrolidone and acrylic acid, and mixtures thereof, even more preferred are polyvinyl pyrrolidone polymers.

Suitable anti-resoiling polymers also include soil suspending polycarboxylate polymers. Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from 2,000 to 10,000, more preferably from 4,000 to 7,000 and most preferably from 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067 to Diehl.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in EP Application No. 66915. Particularly preferred is a copolymer of maleic/acrylic acid with an average molecular weight of 70,000. Such copolymers are commercially available from BASF under the trade name SOKALAN CP5.

Other suitable anti-resoiling polymers include those anti-resoiling polymers having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, 00 $C_4$-$C_6$ alkylene or oxy $C_4$-$C_6$ alkylene segments, or mixtures therein, (iii) poly (vinyl ester) segments, preferably polyvinyl acetate), having a degree of polymerization of at least 2, or (v) $C_1$-$C_4$ alkyl ether or $C_4$ hydroxyalkyl ether substituents, or mixtures therein, wherein said substituents are present in the form of $C_1$-$C_4$ alkyl ether or $C_4$ hydroxyalkyl ether cellulose derivatives, or mixtures therein, and such cellulose derivatives are amphiphilic, whereby they have a sufficient level of $C_1$-$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$-$C_6$ alkylene hydrophobe segments include, but are not limited to, end-caps of polymeric soil release agents such as $MO_3S(CH_2)_nOCH_2CH_2O$—, where M is sodium and n is an integer from 4-6, as disclosed in U.S. Pat. No. 4,721,580 to Gosselink.

Anti-resoiling polymers also include cellulosic derivatives such as hydroxyether cellulosic polymers, co-polymeric blocks of ethylene terephthalate or propylene terephthalate with polyethylene oxide or polypropylene oxide terephthalate, and the like. Such anti-resoiling polymers are commercially available and include hydroxyethers of cellulose such as METHOCEL (Dow). Cellulosic anti-resoiling polymers for use herein also include those selected from the group consisting of $C_1$-$C_4$ alkyl and $C_4$ hydroxyalkyl cellulose; see U.S. Pat. No. 4,000,093 to Nicol, et al. Anti-resoiling polymers characterised by poly(vinyl ester) hydrophobe segments include graft co-polymers of poly(vinyl ester), e.g., $C_1$-$C_6$ vinyl esters, preferably poly(vinyl acetate) grafted onto polyalkylene oxide backbones, such as polyethylene oxide backbones. See EP Application 0 219 048 to Kud, et al. Commercially available anti-resoiling polymers of this kind include the SOKALAN type of material, e.g., SOKALAN HP-220, available from BASF.

One type of preferred anti-resoiling polymers is a co-polymer having random blocks of ethylene terephthalate and polyethylene oxide (PEO) terephthalate. The molecular weight of this anti-resoiling polymers is in the range of from about 25,000 to about 55,000. See U.S. Pat. No. 3,959,230 to Hays and U.S. Pat. No. 3,893,929 to Basadur.

Another preferred anti-resoiling polymers is a polyester with repeat units of ethylene terephthalate units which contains 10-15% of ethylene terephthalate units together with 90-80% of polyoxyethylene terephthalate units, derived from a polyoxyethylene glycol of average molecular weight 300-5,000. Examples of this polymer include the commercially available material ZELCON 51260 (from Dupont) and MILEASE T (from ICI). See also U.S. Pat. No. 4,702,857 to Gosselink.

Another preferred anti-resoiling polymers agent is a sulfonated product of a substantially linear ester oligomer comprised of an oligomeric ester backbone of terephthaloyl and oxyalkyleneoxy repeat units and terminal moieties covalently attached to the backbone. These anti-resoiling polymers are fully described in U.S. Pat. No. 4,968,451 to Scheibel and Gosselink. Other suitable anti-resoiling polymers include the terephthalate polyesters of U.S. Pat. No. 4,711,730 to Gosselink et al, the anionic end-capped oligomeric esters of U.S. Pat. No. 4,721,580 to Gosselink, and the block polyester oligomeric compounds of U.S. Pat. No. 4,702,857 to Gosselink.

Preferred anti-resoiling polymers also include the soil release agents that are disclosed in U.S. Pat. No. 4,877,896 to Maldonado et al, which discloses anionic, especially sulfoaroyl, end-capped terephthalate esters.

Still another preferred anti-resoiling agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred anti-resoiling agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said anti-resoiling agent also comprises from about 0.5% to about 20%, by weight of the oligomer, of a crystalline-reducing stabilizer, preferably selected from the group consisting of xylene sulfonate, cumene sulfonate, toluene sulfonate, and mixtures-thereof. See U.S. Pat. No. 5,415,807 to Gosselink et al.

G. Builder and Buffering Agents

The cleaning composition may include a builder detergent which increase the effectiveness of the surfactant. The builder detergent can also function as a softener and/or a sequestering and buffering agent in the cleaning composition. When employed, the builder detergent comprises at least about 0.001% and typically about 0.01-5% of the cleaning composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri(hydroxymethyl)amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's *Emulsifiers and Detergents*, North American Edition, 1997, McCutcheon Division, MC Publishing Company Kirk and WO 95/07971.

The wipe or cleaning pad can be used for cleaning, disinfectancy, or sanitization on inanimate, household surfaces, including floors, counter tops, furniture, windows, walls, and automobiles. Other surfaces include stainless steel, chrome, and shower enclosures. The wipe or cleaning pad can be packaged individually or together in canisters, tubs, etc. The package may contain information printed on said package comprising a instruction to use the more abrasive side to remove soil followed by using the less abrasive side to wipe the soil away. The wipe or cleaning pad can be used with the hand, or as part of a cleaning implement attached to a tool or motorized tool, such as one having a handle. Examples of tools using a wipe or pad include U.S. Pat. No. 6,611,986 to Seals, WO00/71012 to Belt et al., U.S. patent application Ser. No. 2002/0129835 to Pieroni and Foley, U.S. Pat. No. 6,192,543 to Lee, WO00/71012 to Belt et al., and WO00/27271 to Policicchio et al.

EXPERIMENTAL

Experiments were conducted which demonstrated the effectiveness of the dirt-attracting polycationic polymers in improving soil adhesion to wet cleaning substrates.

EXAMPLE 1

Soil Redeposition Test Using Wet Substrates

This example demonstrated that treated substrates, e.g., cleaning wipes, that included a polyethylene imine (LUPASOL P) exhibited significantly lower levels of dirt re-deposition vis-à-vis untreated substrates. Specifically, treated substrates that were used to continually clean soiled surfaces were less likely to re-deposit dirt from the substrate onto the surface being cleaned. In this experiment, a linoleum surface, that had been cleaned with isopropyl alcohol and dried with a paper towel, was successively soiled with metered quantities of dirt and then cleaned with the same substrate. The amount of dirt used was about 0.05 g of soil commercially available under trade name SPS STARDARD CARPET DRY SOIL from 3M. 2.5 ml of base cleaning solution, described herein, was also applied onto an edge of the linoleum surface adjacent the substrate. Colorimetric readings at five intersections (imitation grout lines) on the linoleum surface were taken initially and after each cleaning series.

At the start of each cleaning series, the soil sample was uniformly sprinkled on the entire surface of the linoleum. The substrate was secured to a mop head that was attached at the end of a long handle. The handle was held at proximately 45 degrees from the floor on which the linoleum was placed. A six pound weight was also attached to the mop head to minimize operator error. Each cleaning series consisted of four manual back-and-forth strokes, or four cycles, of the mop head across the entire surface of the linoleum over five intersections. After each cleaning series, calorimetric readings were taken on the same five reference points. The process continued for five cleaning series.

Three different commercially available substrates consisting of non-woven cleaning pads were tested, namely: (i) CLOROX WET FLOOR WIPES (Clorox Co.), (ii) LYSOL WET WIPES (Reckett Benckiser Inc.), and (iii) PLEDGE WET WIPES (SC Johnson).

For the CLOROX WET FLOOR WIPES, substrates were impregnated a with liquid cleaning composition that was derived by adding sufficient LUPASOL P to a composition, referred to herein as the "Base Cleaning Solution," so that final composition contained 0.15% LUPASOL P by weight. (All percentages herein are based on weight unless noted otherwise.) The Base Cleaning Solution contained (i) 2.0% isopropyl alcohol, (ii) 1.0% propylene glycol n-propyl ether (DOWANOL), (iii) 1.5% alkylpolglycoside, a nonionic surfactant (APG 325N), (iv) 0.1% polyhexamethylene biguanide, an antimicrobial (VANTOCIL P), (v) 0.025% fragrance, and (vi) the balance, water. The solutions were added to each pad in a 6:1 liquid to non-woven substrate weight ratio. The substrates were allowed to equilibrate overnight. The other two substrates were used without modification from their packaging.

Table 1 sets forth the percentage of re-deposition in each instance.

TABLE 1

| Substrate | Square Footage Cleaned | % color change re-deposition | % Increased Redeposition |
|---|---|---|---|
| CLOROX WET WIPE with LUPASOL P | 96 | 0.57 | |
| LYSOL WET WIPE | 96 | 0.87 | +52% |
| PLEDGE WET WIPE | 96 | 0.87 | +52% |
| CLOROX WET WIPE with LUPASOL P | 120 | 0.55 | |
| LYSOL WET WIPE | 120 | 0.99 | +80% |
| PLEDGE WET WIPE | 120 | 1.04 | +89% |

% re-deposition is a measurement calculated from raw data collected with a colorimeter. It is equal to:

$$=\mathrm{SQRT}(((A_0-A_1)^2)+((B_0-B_1)^2)+((C_0-C_1)^2)) \text{ where}$$
$$A=\mathrm{TBD};\ B=\mathrm{TBD},\ C=\mathrm{TBD}$$

As is apparent, significantly less dirt was re-deposited on the cleaned surface when employing the treated substrates. In addition, the data demonstrated that wet substrates were also able to pick up and hold dirt. This suggests that the wet substrates are able to maintain their positive charge density despite the presence of water and other cleaning components.

EXAMPLE 2

Soil Redeposition Test Using Dry Substrates

This example demonstrated that treated dry substrates, e.g., cleaning pads, that included a polyethylene imine (LUPASOL P) also exhibited significantly lower levels of dirt re-deposition vis-à-vis untreated dry substrates. Essentially the same procedure as in Example 1 was used on ceramic tile and vinyl surfaces. Specifically, after the surface was cleaned and dried, 0.05 g of soil was uniformly sprinkled thereon. Then 2.5 ml of the Base Cleaning Solution, described above, was dispensed over the surface. After each cleaning series, which consisted of ten cycles, dirt and base cleaning-solution were re-applied and the process repeated. A total of 15 dirt samples were used for each cleaning pad. Colorimetric readings at five intersections on the tile or vinyl surface were taken initially and after the cleaning series after applying the $10^{th}$ and $15^{th}$ dirt samples.

The non-woven cleaning pads tested are commercially available under the trade name CLOROX READY MOP (CRM) (Clorox Co.) which is a mopping system with a handle and mop head attached thereto. Different amounts of an aqueous solution containing LUPASOL P were sprayed onto the cleaning surface of each pad with a PREVAL aerosol sprayer so that experimental pads were sprayed with the volume equivalent to either 15 or 20 mg of LUPASOL P per pad. Each CRM pad was attached to a mop head that was secured to a handle, which was held at about 45 degrees relative to the floor. A six pound weight was also attached to the mop head.

The results for the vinyl and ceramic tile surfaces are set forth in Tables 2 and 3, respectively. Both sets of data are within 95% confidence intervals. The entries in Table 3 represent the average for the three treated pads.

TABLE 2

| Substrate | Sq. Ft Cleaned | Mg LUPASOL on Pad | % change in color (redeposition of dirt) | % Increased Redeposition |
|---|---|---|---|---|
| CRM with LUPASOL P | 600 | 15 | 0.32 | |
| CRM Control | 600 | 0 | 0.68 | +112% |
| CRM with LUPASOL P | 900 | 15 | 0.50 | |
| CRM Control | 900 | 0 | 1.29 | +158% |

TABLE 3

| Substrate | Sq. Ft Cleaned | Mg LUPASOL P on Pad | % change in color (redeposition of dirt) | % Increased Redeposition |
|---|---|---|---|---|
| CRM with LUPASOL P | 600 | 20 | 0.61 | |
| CRM Control | 600 | 0 | 0.98 | +61% |
| CRM with LUPASOL P | 900 | 20 | 0.60 | |
| CRM Control | 900 | 0 | 1.19 | +98% |

The data in Table 2 for the vinyl surface show that for untreated cleaning pads, re-position of dirt rose dramatically from 0.68%, after the $10^{th}$ dirt sample was cleaned from the surface, to 1.29% after the $15^{th}$ dirt sample. Significant re-deposition is expected since the available surface area on the cleaning pad to hold dirt quickly diminishes as the dirt accumulates. When the dirt-attracting polycationic polymer is applied to the cleaning pads, the level of re-deposition drops significantly. The data also suggest that applying a higher concentration of the dirt-attracting polycationic polymer onto a dry substrate does not necessarily result in lower re-deposition levels. The data in Table 3 for the ceramic tile surfaces showed similar results in that treated cleaning pads left behind significantly less dirt than did the untreated cleaning pads.

EXAMPLE 3

This experiment employed a scanning electron microscopy (SEM) to confirm that treated, non-woven substrates had a higher capacity for retaining dirt particulates than non-treated, non-woven substrates.

CLOROX READY MOP cleaning pads were sprayed with an aqueous 0.15% solution of LUPASOL P. A volume equivalent to 30 mg/pad was applied. After several minutes, using a small flour sifter, the pads were treated with 0.5 grams of 3M sharpsburg soil (a model particulate soil). As controls, CLOROX READY MOP pads were sprayed with water in an amount equivalent to that applied on the treated pad. In both cases, dirt was smeared across each pad until the entire pad was coated with the dirt. The pads were then submerged and immediately removed from a container with 1500 ml of warm water. This dunking process was repeated a total of 20 times. Each pad was dried and analyzed.

For the SEM spectroscopy, 0.75 in. (19.1 mm) by 1.5 in. (38.1 mm) rectangular samples were cut from each cleaning pad. A metallic thin film of gold/palladium was applied on these sections using a S150 Edwards Sputter Coater. This thin electrically conductive film prevents charge build-up. The samples were then examined in the JSM-6300F scanning electron microscope at an accelerating voltage of 2KV. The SEM images showed large numbers of dirt particles attached to surface fibers of the treated pads but only showed relatively few particles attached to the surface fibers of the untreated pads.

EXAMPLE 4

Scanning electron microscopy images of treated and non-treated, non-woven substrates, that had been immersed in an aqueous mixture containing dirt, showed that treated substrates have a higher capacity for attracting dirt particulates from solution than non-treated, non-woven substrates.

15 mm×20 mm rectangular sections were cut from untreated CLOROX READY MOP cleaning pads and from CLOROX READY MOP cleaning pads treated with LUPASOL P at a concentration of 100 mg LUPASOL P/base weight material. An aqueous dirt mixture containing 40 ml of the Base Cleaning Solution, described above, and 0.3 g of 3M Sharpsburg dirt was placed in a 50 ml beaker. The mixture was agitated with a magnetic stirring bar.

Samples of the treated and untreated rectangular sections of the non-woven material were placed into the beaker for 60 seconds with the stirrer on. The samples were removed and then dried at room temperature before being examined under a stereomicroscope at 70×. Next, a metallic thin film of gold/palladium was sputtered coated onto these sections and then examined in the JSM-6300F SEM at an accelerating voltage of 2KV.

When the substrates were initially removed from the dirt mixture, the LUPASOL P treated non-woven substrates were visibly dirtier than the untreated ones. The photomicrographs taken by the stereomicroscope showed that the surfaces of the LUPASOL P treated samples attracted more dirt-particles than the untreated pad. Finally, SEM photographs showed dirt particles being present between the fibers in the LUPASOL P treated samples whereas dirt particles were essentially absent from the untreated fibers.

EXAMPLE 5

The dirt retention captivities of different types of non-woven substrates, both treated with LUPASOL P and non-treated ones, were measured. Specifically, different non-woven-substrates coated with dirt were repeated exposed to water and thereafter were subjected to imaging analysis and panel grading as further described herein.

The substrates tested included (i) mop pads, (ii) paper towels, (iii) 100% cotton swatches, and (iv) cleaning wipes. The mop pads consisted of the CLOROX READY MOP pads, the paper towels consisted of BOUNTY brand paper towels (Procter & Gamble, Inc.), and the cleaning wipes consisted of those used (without disinfectant) in CLOROX DISINFECTING WIPES (Clorox Co.).

A. The mop pads were treated with LUPASOL P or simply sprayed with water, smeared with dirt, and dunked in water following the procedure set forth in Example 3. Thereafter, 10 samples of the treated and untreated mops were tested and graded.

B. Individual sheets of paper towels were also prepared in the same manner as for the mop pads.

C. Cotton swatches were also prepared in the same manner as for the mop pads except that only 0.3 g of dirt (3M Sharpsburg soil) was used.

D. Cleaning wipes containing both LUPASOL P and a cleaning composition were prepared using one of two techniques. In both cases, the initial dry non-woven substrate was a roll of CLOROX DISINFECTING WIPES without liquid composition.

(i) In the first method, the roll of substrate was unwound and sprayed with a 0.15% LUPASOL P aqueous solution and allowed to dry. A volume equivalent to 30 mg/substrate was applied. The roll was rewound, placed in a container and treated with a disinfecting solution that consisted of the following components:

| | |
|---|---|
| N-Alkyl dimethyl benzyl ammonium chloride and n-Alkyl dimethyl ethylbenzyl ammonium chloride | 0.3673 |
| Potassium Citrate | 0.1013 |
| Disodium ethylene diamine tetraacetate | 0.1013 |
| Lauryl dimethylamine oxide | 0.2913 |
| Isopropanol | 4.8893 |
| Fragrance Oil | 0.152 |
| Water | 94.0975 |

The ratio of solution to substrate was 3.5:1. The roll was left to equilibrate overnight to ensure uniform distribution of solution and thereafter a single sheet of wipe was removed from the perforated roll. Using a small flour sifter, the sheet was treated with 0.3 grams of 3M Sharpsburg soil and the dirt was coated over the sheet.

(ii) For the second method, a modified disinfecting solution comprising the above described components and LUPASOL P, at a concentration of 0.15% actives, was prepared. A roll of substrate was rewound, placed in a container and treated with the modified disinfecting solution. The ratio of solution to substrate was 3.5:1. The roll was left to equilibrate overnight and thereafter dirt was applied to individual sheets of wipe as before.

(iii) Cleaning Wipe Control. A single sheets of CLOROX DISINFECTING WIPES, LYSOL DISINFECTING WIPES, ans MR. CLEAN DISINFECTING WIPES were all treated with 0.3 grams of Sharpsburg soil.

Protocol for Measuring Dirt Retention Capacities.

Individual sheets or swatches of the substrates and controls were dunked in 1500 ml of warm water 20 times. They were then dried and allowed to dried and thereafter subjected to panel grading and image evaluation.

A. Visual Panel Grading: Treated and untreated mop pads, paper towels, cotton swatches, and cleaning wipes (10 replicates per group) were randomly organized and graded by 15 trained panelists using a scale of 1=clean and 10=dirty. (The statistical significance of the panel scores was at the 95% interval.) The results are set forth in Table 4.

TABLE 4

| Substrate | Panel Score* |
|---|---|
| BOUNTY Paper Towels with LUPASOL P | 5.2 |
| BOUNTY Paper Towels Control | 2.4 |
| 100% Cotton Swatches with LUPASOL P | 5.6 |
| 100% Cotton Swatches Control | 2.8 |
| CLOROX READY MOP Pads with LUPASOL P | 7.6 |
| CLOROX READY MOP Pads Control | 4.1 |
| CDW | 2.2 |
| CDW (non-woven pretreated with LUPASOL) | 7.4 |
| CDW (LUPASOL added to cleaning solution) | 7.5 |
| LYSOL DISINFECTING WIPES | 3.4 |
| MR. CLEAN WIPES | 3.2 |

As is apparent, the treated substrates were significantly more effective in retaining dirt as they were dirtier. Also cleaning wipes that were impregnated with the LUPASOL P along with the cleaning solution showed comparable dirt retention capabilities relative to those treated with the LUPASOL P first before being impregnated with the cleaning solution.

B. Image Analysis. Images were taken of the paper towels, cotton swatches, and mop pads to quantify the results of the panel grading. Specifically, digital images of the same 10 replicates judged in the panel grading were taken and analyzed. The images were taken with a Hamamatsu IEEE 1394 (12 bit grayscale) digital ccd camera, model C8484-05G (Graftek Imaging, Austin, Tex.). Each sample was illuminated with a StockerYale high frequency (25 kHz) fluorescent light. To control lighting and ensure illumination consistency between samples, all images were acquired in a cardboard enclosure with the room lighting dimmed. The camera contains a ⅔ in. ccd (8.67 mm×6.60 mm). After acquiring the images, the images are masked.

In the case of the mop pads, the center of each pad was masked so that only the mopping area was being analyzed. This corresponded to a total area of 315,770 pixels. A histogram of this area yielded the mean gray value which was used as an indication, of the amount of dirt (a gray value of "0" represents black and a gray value of "4095" represents white in this 12 bit system). Since the lighting was kept constant over the course of this experiment (and the soil is black while the cleaning substrates are white), a lower mean gray value would indicate the presence of more soil. A second measurement of soiling was the number of pixels below a certain threshold value. In the case of pads, the threshold was chosen as 1087. The more pixels below 1087 indicate more darker pixels and would be consistent with more soil removal. There is a statistically significant difference in the average gray level values (LUPASOL mean gray value 1074 vs. mean gray value 1383 for untreated) at the 95% confidence level indicating that the LUPASOL samples are dirtier than the untreated samples. In addition, the number of pixels below gray level 1087 is significantly higher at the 95% confidence level for the pads treated with LUPASOL (LUPASOL treated 196,435 vs. untreated 9,187) indicating again that the LUPASOL treated pads remove more soil.

For the paper towels, after applying the mask, there were 673,816 pixels used for analysis. The threshold chosen was 951. There is a statistically significant difference in the average gray level values (LUPASOL mean gray value 978 vs. mean gray value 1064 for untreated) at the 95% confidence level indicating that the LUPASOL samples are dirtier than the untreated samples. In addition, the number of pixels below gray level 951 is significantly higher at the 95% confidence level for the towels treated with LUPASOL (LUPASOL treated 282,840 vs. untreated 74,838) indicating again that the LUPASOL treated towels remove more soil.

Finally, for swatches, after applying the mask, there were 80,028 pixels used for analysis. The threshold chosen was 1319. There is a statistically significant difference in the average gray level values (LUPASOL mean gray value 1205 vs. mean gray value 1348 for untreated) at the 95% confidence level indicating that the LUPASOL samples are dirtier than the untreated samples. In addition, the number of pixels below gray level 1319 is significantly higher at the 95% confidence level for the swatches treated with LUPASOL (LUPASOL treated 66,103 vs. untreated 28,846) indicating again that the LUPASOL treated swatches remove more soil.

Based on image analysis of these samples, it can be concluded that the LUPASOL treated cloths removed more soil than the untreated materials.

Grey Scale Data for Imaging:

| Type of Substrate | Mean Grey Value | Standard Deviation* |
|---|---|---|
| CLOROX Ready Mop Treated | 1074.7 | 39.3 |
| CLOROX READY MOP Untreated | 1383.5 | 25.7 |
| 100% Cotton Swatches Treated | 1204.9 | 39.6 |
| 100% Cotton Swatches Untreated | 1347.7 | 23.1 |
| BOUNTY Paper Towels Treated | 997.8 | 45.5 |
| BOUNTY Paper Towels Untreated | 1063.8 | 53.9 |

*All comparisons are within 95% confidence interval

Pixel Count Data Using Threshold Values:

| Type of Substrate | Threshold Value | Pixels Below Threshold* | Standard Deviation |
|---|---|---|---|
| CLOROX READY MOP Treated | 1087 | 196435 | 29865 |
| CLOROX READY MOP Untreated | 1087 | 9187 | 5100 |
| 100% Cotton Swatches Treated | 1319 | 66103 | 10061 |
| 100% Cotton Swatches Untreated | 1319 | 28846 | 14058 |
| BOUNTY Paper Towels Treated | 951 | 282480 | 156458 |
| BOUNTY Paper Towels Untreated | 951 | 74838 | 79179 |

*All comparison are within 95% confidence interval

Although only preferred embodiments of the invention are specifically disclosed and described above, it will be appreciated that many modifications and variations of the present invention are possible in light of the above teachings and within the purview of the appended claims without departing from the spirit and intended scope of the invention.

We claim:

1. A wipe comprising:

a. a subbstrate which comprises a nonwoven material, b. wherein said substrate is impregnated with a polycationic polymer selected from the group consisting of polyethyleneimine, copolymers of polyethyleneimine and combinations thereof; wherein said polymer has a molecular weight ranging from about 500,000 to about 2,000,000; and c. wherein said wipe is dry.

2. The wipe of claim 1, wherein said substrate is a cleaning or antimicrobial wipe.

3. The wipe of claim 2, wherein said substrate is attached to a cleaning implement.

4. The wipe of claim 1, wherein said polymer has a charge density greater than 10 meq/g at pH 4.5.

5. The wipe of claim 1, wherein said polymer comprises 0.01 to 0.5% by weight of said wipe.

* * * * *